US007422213B2

(12) United States Patent
Katz et al.

(10) Patent No.: US 7,422,213 B2
(45) **Date of Patent: *Sep. 9, 2008**

(54) GAMES, AND METHODS AND APPARATUS FOR GAME PLAY IN GAMES OF CHANCE

(75) Inventors: Randall Mark Katz, Beverly Hills, CA (US); Gary Dawson, Tarzana, CA (US)

(73) Assignee: Milestone Entertainment LLC, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/440,485

(22) Filed: May 25, 2006

(65) Prior Publication Data

US 2006/0208419 A1 Sep. 21, 2006

Related U.S. Application Data

(63) Continuation of application No. 10/868,519, filed on Jun. 14, 2004, now Pat. No. 7,052,010, which is a continuation of application No. 10/288,276, filed on Nov. 4, 2002, now Pat. No. 6,749,198, which is a continuation of application No. 09/672,179, filed on Sep. 27, 2000, now Pat. No. 6,488,280.

(51) Int. Cl.
*A63B 71/00* (2006.01)

(52) U.S. Cl. ..... 273/138.1

(58) Field of Classification Search ..... 273/138.1
See application file for complete search history.

(56) References Cited

U.S. PATENT DOCUMENTS 3,873,092 A 3/1975 Fagan (Continued)

FOREIGN PATENT DOCUMENTS

WO WO98/43149 A2 10/1998

(Continued)

OTHER PUBLICATIONS

Finders Keepers, 1996 (retrieved from www.stewarttelevision.com on Feb. 25, 2004).
Top That II, 1996 (retrieved from www.stewarttelevision.com on Feb. 25, 2004).

(Continued)

*Primary Examiner*—Gene Kim
*Assistant Examiner*—Dolores Collins
(74) *Attorney, Agent, or Firm*—O'Melveny & Myers LLP

(57) ABSTRACT

The inventions herein relate to novel games of chance and apparatus and methods for their play. In one embodiment, a multi-level game of chance is played by presenting the player with multiple options, where there is at least one positive option and at least one negative option. By way of example, at each level the player selects one of four boxes, where two have a monetary amount, and one has a strike. Optionally, the fourth box may comprise a 'mystery box', which requires a decision within a decision. When presented with the mystery box, the player may elect to open it or not. If they do not open it, game play resumes at the existing game level. If they open it, one of multiple options is presented, including a positive option and a negative option. In the preferred embodiment, the positive option could include: a multiplier of the winnings of the player, e.g., a double of the money in the player's account, or the updating of the safe level for the player. A negative result could be an additional strike. Preferably, the probability of a negative outcome from the opening of the mystery box should be the same as the probability of a negative event the general playing of the game. In studio participation, casino based play, or play over an electronic network, such as the Internet, is contemplated.

57 Claims, 3 Drawing Sheets

U.S. PATENT DOCUMENTS 4,348,027 A 9/1982 Escamilla-Kelly
4,582,324 A 4/1986 Koza et al.
4,772,025 A 9/1988 James et al.
4,836,546 A 6/1989 DiRe et al.
4,883,278 A 11/1989 Scott
5,035,422 A 7/1991 Berman
5,074,566 A 12/1991 Desbiens
5,112,050 A 5/1992 Koza et al.
5,157,602 A 10/1992 Fields et al.
5,269,521 A 12/1993 Rossides
5,271,626 A 12/1993 Llenas et al.
5,317,135 A 5/1994 Finnocchio
5,407,199 A 4/1995 Gumina
5,409,234 A 4/1995 Bechter
5,417,424 A 5/1995 Snowden et al.
5,472,196 A 12/1995 Rusnak
5,475,205 A 12/1995 Behm et al.
5,513,852 A 5/1996 Robinson
5,518,253 A 5/1996 Pocock et al.
5,569,082 A 10/1996 Kaye
5,620,182 A 4/1997 Rossides
5,628,684 A 5/1997 Bouedec
5,643,088 A 7/1997 Vaughn et al.
5,651,735 A 7/1997 Baba
5,685,541 A * 11/1997 Lovell, Sr. ..... 273/139
D387,390 S 12/1997 Seiler
5,697,844 A 12/1997 Von Kohorn
5,709,603 A 1/1998 Kaye
5,721,583 A 2/1998 Harada et al.
5,772,510 A 6/1998 Roberts
5,785,315 A 7/1998 Eiteneer et al.
5,791,990 A 8/1998 Schroeder et al.
5,813,913 A 9/1998 Berner et al.
5,816,575 A * 10/1998 Keller ..... 273/292
5,855,514 A 1/1999 Kamille
5,857,175 A 1/1999 Day et al.
5,871,398 A 2/1999 Schneier et al.
5,909,875 A 6/1999 Weingardt
5,931,467 A 8/1999 Kamille
5,935,001 A 8/1999 Baba
5,936,661 A 8/1999 Trew
5,949,042 A 9/1999 Dietz, II et al.
D420,057 S 2/2000 Colombo
6,048,268 A 4/2000 Humble
6,102,395 A 8/2000 Such
6,102,400 A 8/2000 Scott et al.
6,193,610 B1 2/2001 Junkin
6,203,011 B1 3/2001 Nulph
6,238,288 B1 5/2001 Walker et al.
6,241,246 B1 6/2001 Guttin et al.
6,241,606 B1 6/2001 Riendeau et al.
6,250,685 B1 6/2001 Walker et al.
6,251,017 B1 6/2001 Leason et al.
D444,507 S 7/2001 Lundberg
6,267,376 B1 * 7/2001 Jenkins ..... 273/258
6,273,817 B1 8/2001 Sultan
RE37,371 E 9/2001 Gerow
6,290,600 B1 9/2001 Glasson
6,309,298 B1 10/2001 Gerow
6,312,334 B1 11/2001 Yoseloff
6,322,446 B1 11/2001 Yacenda
6,354,593 B1 3/2002 Frommer et al.
6,382,627 B1 5/2002 Lundberg
6,435,500 B2 8/2002 Gumina
6,443,452 B1 9/2002 Brune
6,475,085 B2 11/2002 Moody
6,488,280 B1 * 12/2002 Katz et al. ..... 273/138.1
6,491,215 B1 12/2002 Irwin, Jr. et al.
6,497,408 B1 12/2002 Walker et al.
6,514,144 B2 2/2003 Riendeau et al.
6,547,242 B1 4/2003 Sugiyama et al.
6,565,084 B1 5/2003 Katz et al.
6,607,439 B2 8/2003 Schneier et al.
6,749,198 B2 * 6/2004 Katz et al. ..... 273/138.1
6,749,500 B1 6/2004 Nelson et al.
6,811,484 B2 * 11/2004 Katz et al. ..... 463/17
6,824,469 B2 11/2004 Allibhoy et al.
7,052,010 B2 * 5/2006 Katz et al. ..... 273/138.1
2002/0090986 A1 7/2002 Cote et al.
2002/0151344 A1 10/2002 Tanskanen
2003/0003988 A1 1/2003 Walker et al.
2003/0045340 A1 3/2003 Roberts
2003/0060261 A1 3/2003 Katz et al.
2003/0060276 A1 3/2003 Walker et al.
2004/0259631 A1 12/2004 Katz et al.

FOREIGN PATENT DOCUMENTS

WO WO99/11008 A2 3/1999
WO WO 01/03786 A1 1/2001
WO WO 01/42968 A1 6/2001
WO WO 01/76704 A2 10/2001

OTHER PUBLICATIONS $10,000 Championship, one version for $50,000 broadcast in 1996 (retrieved from www.stewarttelevision.com on Feb. 25, 2004).

Schwartz, et al., The Encyclopedia of TV Game Shows, 3rd Edition, pp. 22, 23, 48-49, 90, 98-99, 178-180.

www.geocities.com/TelevisionCity/1856/rules.htm, Card Sharks, Apr. 24, 1978, 1-3.

Summons, filed Apr. 19, 2007, in *Sande Stewart Television, Inc.* v. *Milestone Entertainment, LLC*, Civil Action No. CV-07-2606 GHK(CWx).

Complaint for Declaratory Judgement, filed Apr. 19, 2007, in *Sande Stewart television, Inc.* v. *Milestone Entertainment, LLC*, Civil Action No. CV-07-2606 GHK(CWx).

First Amended Complaint for Declaratory Judgement, filed May 22, 2007, in *Sande Stewart Television, Inc.* v. *Milestone Entertainment, LLC*, Civil Action No. CV-07-2606 GHK(CWx).

Answer to First Amended Complaint, filed Jun. 12, 2007, in *Sande Stewart Television, Inc.* v. *Milestone Entertainment, LLC*, Civil Action No. CV-09-2606 GHK(CWx).

Certification and Notice of Interested Parties, filed Jun. 12, 2007, in *Sande Stewart Television, Inc.* v. *Milestone Entertainment, LLC*, Civil Action No. CV-07-2606 GHK(CWx).

Answer to First Amended Complaint, filed Jun. 12, 2007, in *Sande Stewart Television, Inc.* v. *Milestone Entertainment, LLC*, Civil Action No. CV-07-2606 GHK(CWx).

First Amended Complaint for Declaratory Judgement, filed May 22, 2007, in *Sande Stewart Television, Inc.* v. *Milestone Entertainment, LLC*, Civil Action No. CV-07-2606 GHK(CWx).

Stipulation for Dismissal Without Prejudice Pursuant to FRCP 41(a) in *Sande Stewart Television, Inc.* v. *Milestone Entertainment, LLC*, Civil Action No. CV-07-2606 GHK(CWx).

* cited by examiner

GAMES, AND METHODS AND APPARATUS FOR GAME PLAY IN GAMES OF CHANCE

RELATED APPLICATION INFORMATION

This application is a continuation of Ser. No. 10/868,519, filed Jun. 14, 2004, entitled "Novel Games, and Methods and Apparatus for Game Playing Games of Chance", issued as U.S. Pat. No. 7,052,010, which is a continuation of Ser. No. 10/288,276, filed Nov. 4, 2002, entitled "Novel Games, and Methods and Apparatus for Game Play in Games of Chance", issued as U.S. Pat. No. 6,749,198, which is a continuation of Ser. No. 09/672,179, filed Sep. 27, 2000, entitled "Novel Games, and Methods and Apparatus for Game Play in Games of Chance", issued as U.S. Pat. No. 6,488,280, and is related to application Ser. No. 09/585,987, filed Jun. 2, 2000, entitled "Novel Games, and Methods for Improved Game Play in Games of Chance and Games of Skill", which is incorporated herein by reference as if fully set forth herein.

FIELD OF THE INVENTION

These inventions relate to methods, an apparatus for their implementation, of unique player participation games, and for improved methods of play for games of chance. More particularly, these inventions relate to new and improved games involving player participation in a broadcast medium, such as television, and in other communication media, such as over the Internet or other communications network.

BACKGROUND OF THE INVENTION

Player participation games fall broadly under the categories of games of chance and games of skill. One of the main forms of games of chance is lotteries. By definition, involve the three elements of: 1) prize, 2) chance and 3) consideration. If these three elements are present, then the game is considered to be a lottery, and is typically then run by a governmental entity. In the United States, lotteries are typically run by the individual states, or collectively by a group of states. In other countries, it is typically the national government that runs the lottery. Countries and states attempt to strictly limit the game play to their geographic boundaries. For example, in Austria, while electronic access to the game may be available over the Internet, or in order to play, the person must have a bank account in Austria, and be able to navigate the non-english menu.

Games have been conducted in any of a number of formats. Certainly, live, in person games have been performed. Yet other games have been played and broadcast over a broadcast medium, such as radio or television. Yet other games have been played through a more active communication media, such as the telephone, or over a communication network such as the Internet.

Various attempts have been made to provide game play over the Internet. By way of example, the game show Jeopardy has been placed on the web at http://www.sony.com.

Various other attempts have been made to extend the general concept of gambling to broad communication media, such as the Internet. For example, U.S. Pat. No. 5,800,268 entitled, "Method of Participating in a Live Casino Game from a Remote Location" has been asserted in a litigation in against an off shore corporation. The '268 patent discloses a system in which a player may participate in a live casino game from a location remote from the casino. A player interface station, such as a computer terminal or other special input device, is connected by a communication line to the casino. A second communication line is established from the casino to the player's financial institution. The player is presented with an image of an actual "live" game. The player then participates directly as if they were physically present at the casino. A wager is cleared with the player's financial institution to insure adequate resources to cover the bet.

U.S. Pat. No. 4,845,739 to Ronald A. Katz is entitled, "Telephonic—Interface Statistical Analysis System". The patent describes various operating formats, including a format to be performed in association with television media. Specifically, in one embodiment, a real-time format is provided in which television viewers participate on a real-time basis in a game show for prizes. Expanded audience participation is achieved. Various levels of qualification are provided, such as where a child's television game format is utilized, parental clearance may be required. The use of personal identification numbers (pin numbers) is disclosed. In one implementation, the caller is prompted to identify which of the actual studio audience participants the caller will be aligned with. Additionally, the caller may be instructed to indicate the extent of a wager. As the game progresses, the individual player's accounts are credited or debited, thereby providing on-going accounting data. In yet another implementation, a non real-time operation is provided. Such a show might involve a quiz for callers based on their ability to perceive and remember occurrences within the show. Pre-registration is optionally utilized. In this implementation, a sequence or time clock would be utilized in order to limit or control individual interfaces to a specific time or geographic "window". In this way, the caller questions may be utilized across various time zones without the caller having obtained the question earlier than other callers within a given time zone.

Berman, U.S. Pat. No. 5,108,115 discloses a game show and method entitled "Interactive Game Show and Method for Achieving Interactive Communication Therewith". An interactive communication system is provided which permits individuals to electronically select at least one possible outcome of a plurality of outcomes of a future event. Successful contestants possibly share in a prize award associated with the event. A home audience of a televised game show may electronically communicate a series of random numbers using their touch tone telephone to participate in the show.

Recently, various governmental entities and trade organization have addressed the issue of game play over the Internet. Congressman Kye has introduced a bill which would preclude the offering of Internet based gaming, though permitting states to offer Internet gambling. Consideration has been given to requiring that the state sponsored gaming be limited to an intranet, in an effort to limit those participating to persons physically resident within the states boundaries. Various international lottery organizations have promoted similar restrictions, namely, precluding the individuals offering of games of chance, and reserving that option exclusively to the state.

Various lottery formats are known to the art. In one classic format, a pre-determined number of tickets are provided with certain printed matter, such as numbers or other indicia, where the information is then obscured by a scratch off layer. By removing the layer and revealing the underlying information, the ticket holder may determine whether they have won or not. Various extensions have been made to a "virtual" scratch off ticket where no physical ticket is provided.

A conventional lottery proceeds as follows. First, a series of numbers are selected, either by the player or by some automated selection system, such as by computer. Upon the occurrence of a pre-determined event, such as on a set date and time, numbers are randomly chosen. Both mechanical methods, such as selection of ping-pong balls bearing numeric designations, or electronic means such as through a random number generator, may be utilized. The selected numbers are then provided to the participants, such as through a broadcast medium like newspapers, radio and television. Finally, the holder or holders of winning tickets then present their ticket for payment.

In yet another aspect of game play, a typical television presented game show lasts on the order of one half hour. Various shorter format games or shows have been utilized, for example, a football based advertisement or game has been presented by IBM during televised football games under the name "You Make the Call". Yet other shorter version games have been presented over web TV or on the Game Show Network.

The television game show "Who Wants to be a Millionaire" is believed to have originated in Britain, and has become extremely popular in the United States. The game is a trivia game. While being principally a game of skill, the nature of the questions, or the contestants knowledge of the potential answers, makes the game at times a guessing game or game of chance. The format consists of one contestant and one host. The contestant is presented with a question and four possible answers. If the contestant answers the question correctly, they advance to a next level, each level being associated with a higher monetary prize amount, which is roughly twice the amount of the preceding level. A contestant is given three "life lines": a "50/50" where in two incorrect answers are removed, thereby leaving the correct answer and one incorrect answer, the "phone a friend", wherein the contestant may call a friend by telephone and solicit their response to the question, subject to a 30 second time limit, and an "ask the audience" option where the audience is polled regarding their view of the correct answer to the question. Various safe levels are established, such as at $1,000.00 such that the contestant would be awarded that amount of money in the even that they fail to correctly answer a question. Finally, after a question is posed, the contestant may elect to discontinue play, and to receive that amount of money won at the preceding level.

Despite the wide spread participation in various forms of game play, as well as the suggestions for implementing those games on a mass communication network, such as through the telephone or Internet, the possibility for new games, or improved game play exists. In particular, there is a need for improved games of chance, which provide excitement for the player, and optionally a viewer audience.

SUMMARY OF THE INVENTION

This invention relates to methods and associated apparatus for novel game play. In the preferred embodiment, the game is a game of chance.

In the preferred embodiment, the game is played at a multiple number of levels. At each level, the contestant is presented with multiple options, such as a depiction of four uniquely labeled boxes, amongst which the contestant may choose. The options would include at least one positive outcome and at least one negative outcome. In the case of four boxes, e.g., one could include a strike, two could include a monetary amount, which may be either the same or different and optionally, the fourth box could comprise a mystery box, described below. The contestant selects, at random, one of the options. If the option selected is one of the positive options, such as a monetary amount, they proceed to the next level and the winnings are added to the prior winnings total. If a negative option is selected, such as a strike, in the preferred embodiment, the level is reset and play continues at that level. Preferably, the player is allowed a predetermined number of negative events, such as three strikes, prior to discontinuing play.

The 'mystery box' consists of a decision within a decision. A first decision was to select that option, which then was revealed as comprising a mystery box. The player is then given the option of whether to reveal that option. The option within the mystery box would include at least one positive result and at least one negative result. In the preferred embodiment, there would be three results possible with a mystery box, a positive result such as a multiplier for the money, such as a doubler of the contestant prior' winnings, an updating of the safe level for the player or an additional monetary amount. Alternatively, other positive results such as a free play or a reduction in the number of negative events is possible. Preferably, the probability of a negative result from the opening of the mystery box should be equal to the probability of a negative event if the mystery box were not selected.

The prizes at the various levels may be set as desired to result in a predetermined pay out for the game. Optionally, guaranteed low end prize structures (GLEPS) may require payment of predetermined prize amounts, and possibly payment of a minimum amount of a prize e.g., $500.00. The monetary spacing between various levels may be set as desired, either as an arithmetic progression or as a multiplicative progression, e.g., a substantial doubling of the prize amount at every level. Optionally, when a maximum game level is reached a jackpot or other proportionally large prize may be awarded. If the jackpot is not won in a given game, it may then roll over to a subsequent game. Alternative forms of progressive play may be utilized.

In another aspect of this invention, game play in a first game may require progression through a plurality of levels, leading to game play on a second game for those who have reached the maximum level on the first game. In one implementation, the maximum prize level in the first game may be equal to the minimum prize level in the second game.

Various modes of play are contemplated. In studio game play may be utilized with a broadcast, either live or for taped replay. Yet another mode of game play involves playing at a gaming venue, such as where other games of chance, e.g., slot machines, are played. Yet another venue may consist of game play by the player from their hotel room in a venue which allows gambling. In yet another mode of game play, a network, such as the internet, may be utilized to permit game play, whether for a monetary amount or to provide other points or indications of score. The game may be played in any venue where not prohibited, whether on land or in an airplane or ship, and may be played in any form of wired or wireless environment, such as via hand-held web enabled communication devices.

The game may be played by a single individual, or may be played with multiple players. The multiple players may play against one another, for scoring, or may merely play in parallel without further interaction.

Accordingly, it is an object of this invention to provide an improved game of chance having a higher level of audience interest and potential participation.

It is yet another object of this invention to provide for an improved Internet game of chance.

It is yet a further object of this invention to provide for enhanced modes of game play in association with existing forms of game play.

DETAILED DESCRIPTION OF THE INVENTION

Figure 1:
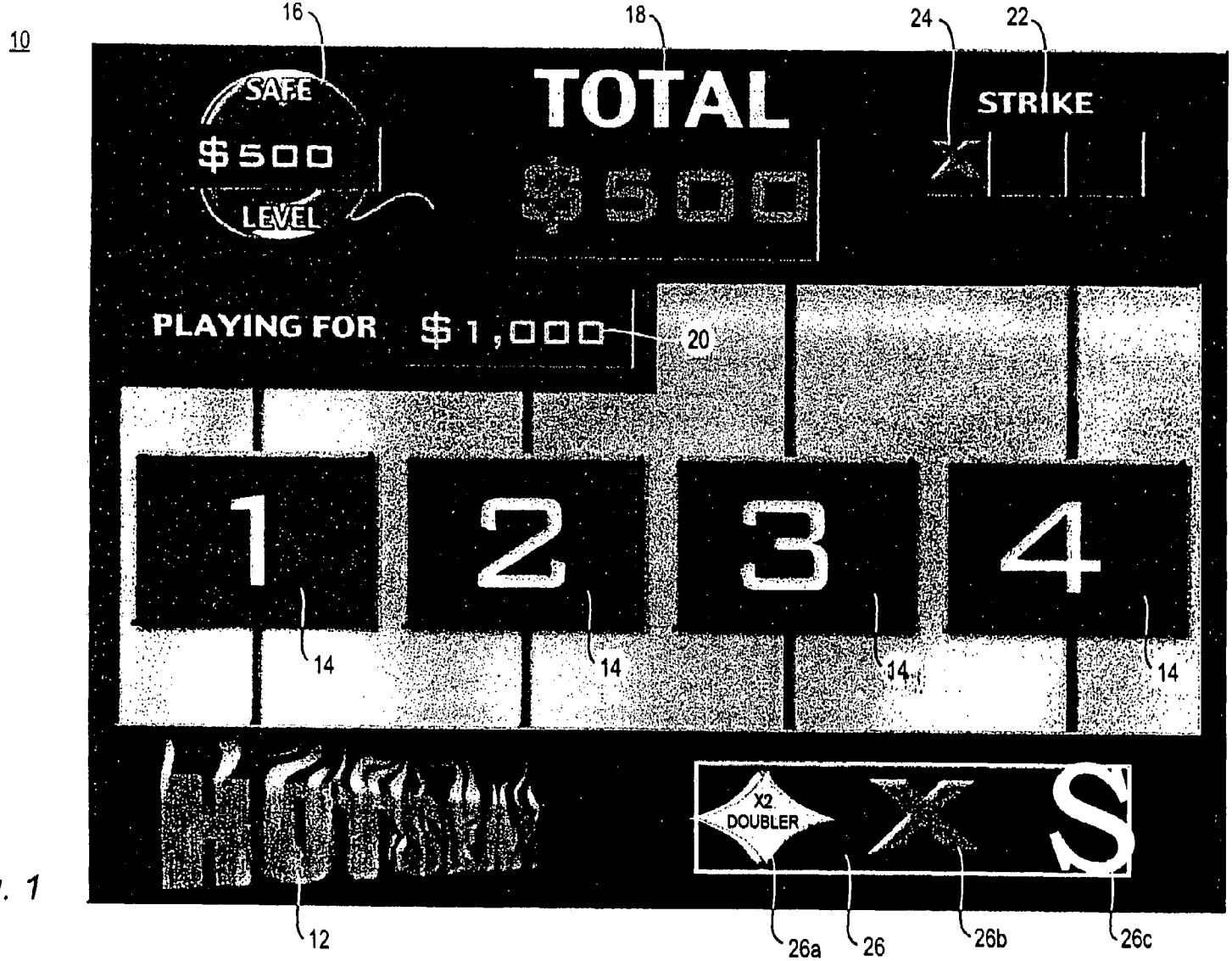
FIG. 1 shows a screen of the type particularly adapted for a broadcast type format.

FIG. 1 is a view of one possible display for use in game play. For example, the depiction may be of a portion of a broadcast studio with associated game play, such as for television broadcast. The display 10 may optionally include a logo or other word mark region 12. The multiple options presented to the players may be depicted as uniquely designated boxes 14. While shown as numbers in FIG. 1, the designators for boxes 14 may be of any form, such as letters, characters or other visual depictions. The display preferably will include other functional aspects of the game. A safe level display 16 displays that amount of money or points which are guaranteed to the player in the event that they can no longer continue with the game given that they have reached a predetermined negative level. The total display 18 shows the total amount of money, points, prizes (cash or non-cash) or other winnings accumulated by the player. The strike display 220 shows a depiction of the number of negative events, here strikes, which have occurred. As shown, the display 10 contemplates three strikes in the game. As shown, sub box 24 includes a "X" indicating one strike.

Display region 26 shows the possible outcomes from the selection of the mystery box or other denominated decision within a decision. As shown in display 10, the outcomes of the mystery box include a multiplier for the monetary amount previously won by the player, here shown to be a multiplicative doubler of the monetary amount (shown at 26*a*), or a negative result, such as a strike (shown at 26*b*) or an updating of the safe level (as shown at 26*c*).

Figure 2:
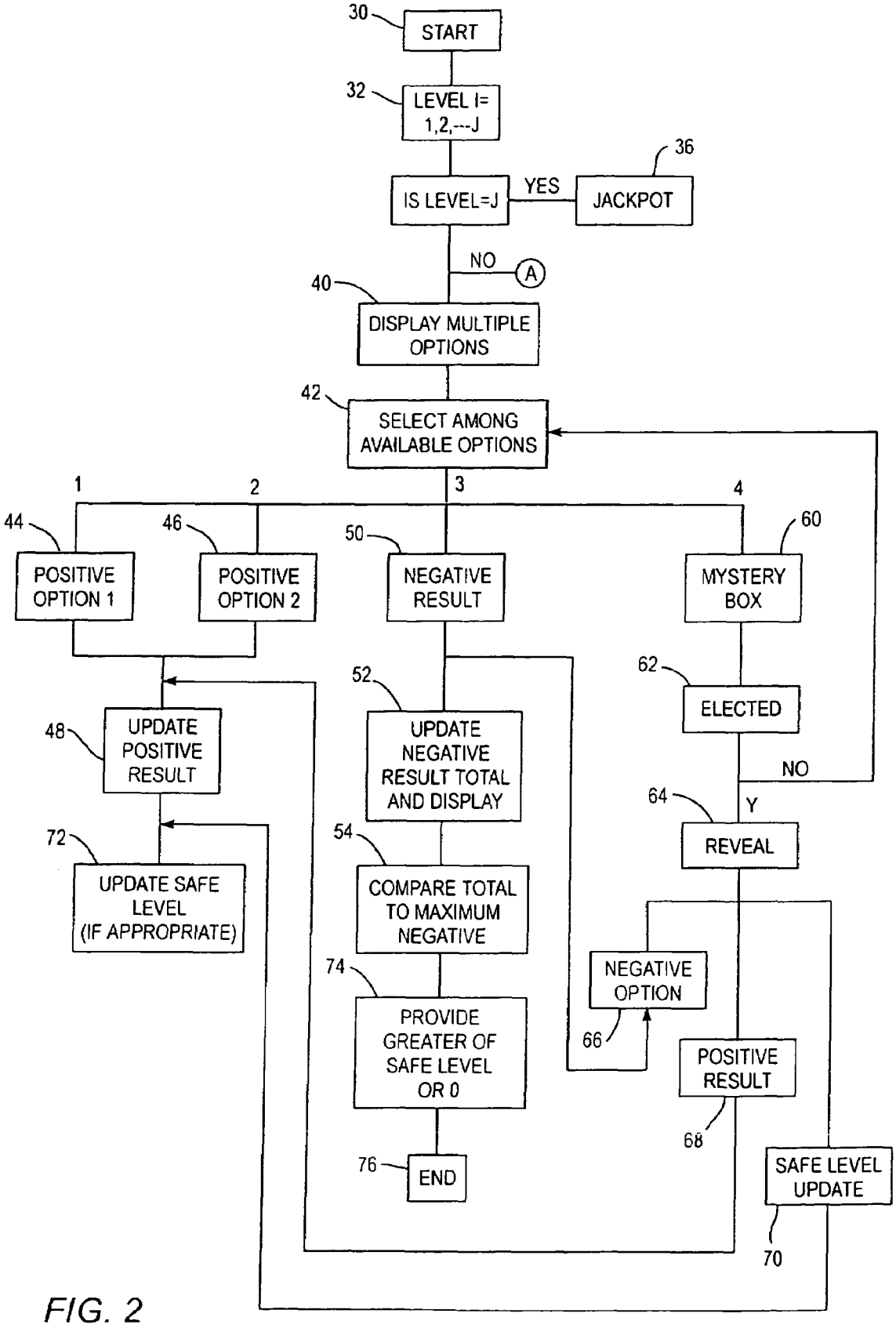
FIG. 2 is a flow chart showing options for game play.

FIG. 2 is a flowchart of one implementation of the game format. The game starts with start box 30. Level box 32 indicates the multiple levels possible for game play. Game play begins at the first level. The number of levels ends at the first level. The number of levels may be chosen consistent with the expected pay out and desired duration of the game. In a half-hour or full hour broadcast format, 10 or 15 game levels may be desired. In contrast, a sixty second or few minute game may only involve three, four or five levels. Decision box 34 determines whether the maximum level J has been reached, and if so, indicates that the jackpot 36 is to be awarded. In the event that the jackpot is not awarded, it may be rolled over for future games.

Returning now to the flowchart, the multiple options 40 are displayed to the contestant. As shown in FIG. 1, the multiple options could comprise four uniquely numbered boxes or squares. Any form of display or random selection may be utilized. Thus, while the term "display" is utilized, it should be construed in a manner consistent with selecting, such as where an alternative random selection method is utilized. One possible alternative is the ping pong ball draw, such as where the balls are distinguishable and are drawn by the machine. Yet another selection method could include a computer generated selection, such as through the use of a random number generator. Thus, the output of selection box 42 is a determination of one of the various possible outcomes from that election or selection.

As shown in FIG. 2, two positive options, positive option 1 44 and positive option 2 46 are shown. The positive options 44, 46 may represent a monetary amount, a point value or other financial or prize information. In the preferred embodiment, the positive options are of an equal amount, though they may be of differing amounts or of differing types of prize.

The negative result box 50 may be of various types. In the preferred embodiment, the negative result 50 may comprise a strike. Preferably, the game is structured as to permit a predetermined number of strikes, such as 3 strikes, prior to the player losing the game. In such a system, the system would update the negative result tally at box 52, and perform a comparison 54 of the totaled number of negative events to the maximum number of negative events allowed. If the comparison 54 indicates that the maximum number has been reached, then program flow proceeds to box 74 where the player is awarded the last existing safe level amount, or if no such safe level amount exists, then whatever minimum prize is indicated according to the rules. That minimum amount may be 0 or some other guaranteed amount. Certain lottery systems require guaranteed low-end prize structure (GLEPS) which guarantee a certain prize or result for certain contestants.

The fourth option shown in FIG. 2 consists of the mystery box 60. In the preferred embodiment, the competitor is given the option at decision stage 62 whether to reveal the content of the mystery box. If the player elects not to elect the content of the mystery box, then play resumes at the same level with four boxes. However, if the player elects to reveal the content at step 64, the content may consist of a negative option 66, positive result 68 or safe level update 70. In the event that the negative option 66 is selected, the negative result is updated at box 52, with the player indicated comparison step 54 being performed. Program operation is the same as for the flow leading from the negative result box 50. In the event that a positive result 68 occurs, the program flows to box 48 for an update of the positive result. For example, if the positive option 1 44 is a monetary amount, the monetary amount may then be added to prior winnings, or alternatively may be the entirety of the award which may be won.

If the safe level update box 70 is selected, the safe level is updated at box 72. In this way, when the player has reached the maximum number of events at box 54, the safe level amount 72 is then provided. After the update of the positive result 48, and optionally, an update of the safe level 72, program flow returns to the level selection 32, at which time the next higher level is selected.

In the preferred embodiment if the number of negative results is less than the maximum number of negative results (box 54), then the decision flows to path A, which returns the player to the decision to select among the available options 42. In the preferred embodiment, when the player has received a strike at a given level, the level is reset and played again. Alternatively, in the event of a negative event, the negative event could be tallied and the player advanced to the next level.

Figure 3:
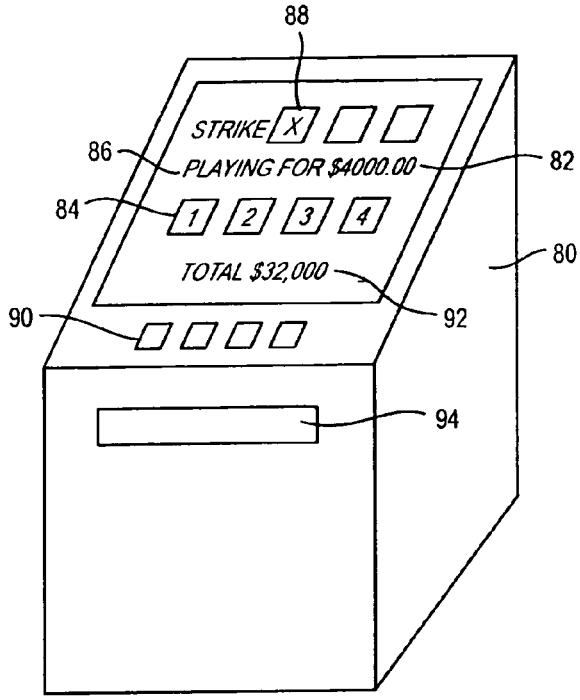
FIG. 3 shows a perspective view of a casino type apparatus.

FIG. 3 shows a perspective view of a device for use at a gambling or gaming venue. A housing 80 may include a display 82, such as a CRT or flat panel display, on which is displayed the multiple options 84. The other information or designations may be as described in connection with FIG. 1 and FIG. 2. For example, the display 82 may include a designator 86 for the amount the gamer is playing for. A display 88 may visually depict the number of strikes existing. A selection system 90, such as an array of buttons is utilized for player input of the desired selection. However, any mode or manner of input may be utilized. For example, a computer mouse, voice detection system or other input mechanism permitting the player to interface with the machine may be utilized consistent with the goals and objects of this invention. The display may include a depiction of the total amount then won, or comprising a safe level. Optionally, a slot 94 for pay back of a player's winnings may be provided. Alternatively, the payment format may be of any various mode, such as if players based upon the use of credit card information, the credit card may be provided with a credit in the event that the player is a winner.

The displays of FIG. 1 and FIG. 3 may be of various types and resolution. For example, certain of the displays may be in a standard resolution format, whereas others may be in a high resolution format. Certain of the displays may show a graphical image, whether static or dynamic, and yet other displays may show textual information. Combinations of any of the preceding, e.g., text on certain displays and high resolution dynamic images on other displays, may be utilized.

In addition to visual displays, voice prompts may be provided, such as where the contestant is prompted to enter information or is otherwise cued to provide a responsive action. Voice input to the system is also feasible.

Figure 4:
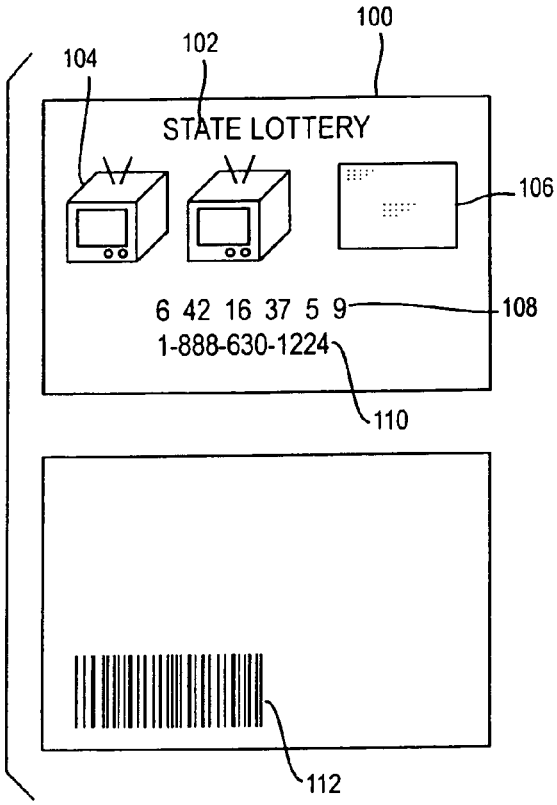
FIG. 4 shows a lottery ticket for possible participation in a feature broadcast game show.

FIG. 4 shows a ticket 100 having a front face and a back face. The ticket 100 may include textual data such as state lottery or may include other graphic indicia indicative of the game. In one implementation, the lottery ticket 100 includes a means or mechanism for the players to be selected for inclusion in a broadcast in the underline game. A scratch off layer 106 is deposited an operative portion of the ticket, which, when removed, reveals images. As shown in FIG. 4, the scratch off layer has already been removed from the left and center images, depicting the television sets. Thus, if the player were to possess a card 100 that had three television sets, that may form the basis for their participation in the broadcast game show, or to permit them to participate in the selection process leading to the broadcast game. By way of example, having a lottery ticket with three similar images may permit the player to be entered into a drawing or other selection mechanism for game play.

The images 104 and game play associated therewith may be in addition to the game play of a lottery, such as designated by the numbers 108. Thus, if a player purchases a ticket and receives numbers 108, they may be additionally entitled to play the game depicted by the graphics 104 for possible play on a future lottery game show. In this way, interest in a future lottery game may be created through game play on an existing lottery.

As shown, the ticket 100 optionally includes a bar code 112. As shown, the bar code 112 is disposed on the backside of the lottery ticket. The bar code 112 may be placed wherever desired. In operation, the machine readable bar code may be utilized for tracking or other monitoring purposes.

Figure 5:
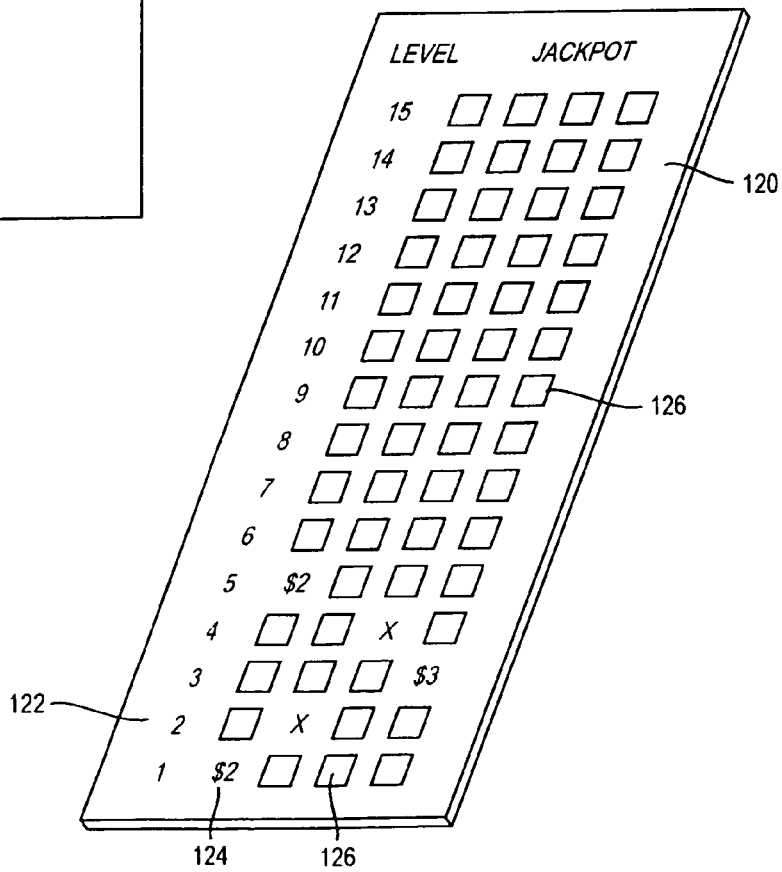
FIG. 5 shows a perspective view of a scratch off implementation of the game.

FIG. 5 shows a perspective view of a ticket or card 120 representing a scratch off version of the multilevel game. Card stock or other substrate 120 has printed thereon an indication of the various levels of the game 122, such as 1, 2, 3 . . . 15. The player is presented with multiple regions 126 for scratch off. As shown, the player having scratched off the first box at level 1 revealed a winning prize of $2.00 at level 2, the player selected the second column, which results in a strike or X. At level 3, the player revealed the right most scratch off, revealing a winning number of $3.00. At level 4, an X was revealed in the third column. At this point, the player has two strikes. The player has then further elected at level 5 to reveal the scratch off in the first column. Thus, at this stage, the player has $7.00 of revealed winnings and two strikes. At this stage, the player could elect to discontinue play. The ticket may then be brought to a redemption center and receive the money in exchange for the ticket. In the event that the player continued to reveal obscure information, and that the predetermined number of negative events, such as 3 strikes, was reached, the ticket would become void and no compensation would be provided.

The games of this invention may be adapted to and on-line selection format, such as where a potential player purchases a lottery or lotto ticket at a retail vending location. The player may be prompted to provide their selection of numbers, such as where they provide one of four numbers for each level. That information may then be passed in an on-line manner to the lottery system. Optionally, game play on the television or other broadcast media may be used for game play by the viewing audience. For example, the game play of successful game play at a given level may be compared to the player's selections previously made through the on-line process. Improved audience viewing levels of a game of chance would result.

The game described herein may be played in any variety of format. For example, the game may be played in a 30 minute or 1 hour television broadcast type format. Alternatively, the game is a adaptable to a short, e.g., 60 second, format. Game play may be done in a broadcast mode, such as through in studio participation, either live or taped. Alternate modes may be utilized, such as in a gaming or gambling establishment. Game play may be over a network, such as the Internet. In an Internet game the player may provide credit card information or otherwise have an account with a monetary stake, and that amount may be increased or decreased as the player wins or loses. Alternatively, instead of money, the player may play for points.

Contestant selection may be done by any number of modes or modalities. For example, as described in connection with FIG. 4, a scratcher type ticket approach may be utilized. Alternatively, an online ticket may be utilized wherein during the printing of the play slip (to reflect the numbers either selected by the customer or generated by a quick pick). In an alternative implementation, Internet play, such as the high score may be utilized to select future contestants. In yet another implementation, a real time selection may be utilized, such as where a player is on the net and is selected by the system for future game play.

Although the foregoing invention has been described in some detail by way of illustration and example for purposes of clarity and understanding, it will be readily apparent to those of ordinary skill in the art in light of the teachings of this invention that certain changes and modifications may be made thereto without departing from the spirit or scope of the appended claims.

What is claimed:

1. A method for game play in a game of chance culminating in one or more winners, comprising the steps of:

presenting, in a first phase, a plurality of random options, wherein at least one option is a positive option, at least one option is a negative option and at least one option requires a decision beyond selection of that option, receiving a selection from a player regarding which one of the plurality of random options is selected, and if the positive option was selected, permitting the option of continued game play but if the negative option was selected, cumulating the negative option result, comparing the cumulative result with a predetermined number, and (1) if the cumulative result is less than the predetermined number, permitting the player to (a) terminate game play and receive a prize based on the number of positive options selected or (b) continue game play and (2) if the cumulative number equals the predetermined number, terminating game play as to that player, and repeating the above steps until the winning player is identified or game play discontinued.

2. The method for game play of claim 1 wherein the positive result comprises a monetary amount.

3. The method for game play of claim 1 wherein the positive result comprises a point amount.

4. The method for game play of claim 1 wherein the negative result comprises a strike.

5. The method for game play of claim 1 wherein the predetermined number is three.

6. The method for game play of claim 1 wherein the predetermined number is greater than three.

7. The method for game play of claim 1 wherein the number of random options is three.

8. The method for game play of claim 1 wherein the number of random options is four.

9. The method for game play of claim 8 wherein there are two positive options among the random options at given level.

10. The method for game play of claim 9 wherein the two positive options are the same.

11. The method for game play of claim 1 wherein the two positive options are different.

12. The method for game play of claim 1 wherein there are at least five levels.

13. The method for game play of claim 1 wherein there are at least ten levels.

14. The method for game play of claim 1 wherein there are at least fifteen levels.

15. The method for game play of claim 1 wherein the options are presented in a graphical display.

16. The method for game play claim 15 wherein the graphical display has one object for each option.

17. The method for game play of claim 16 wherein the display is a numbered box.

18. The method for game play of claim 16 wherein the display is a lettered object.

19. The method for game play of claim 16 wherein the display includes graphical images of objects.

20. The method for game play of claim 1 wherein the options are selected by random selection.

21. The method for game play of claim 20 wherein the random selection is a ball draw.

22. The method for game play of claim 1 wherein the random selection is an electronic random number generator.

23. The method for game play of claim 1 wherein the various options are designated by letters on boxes.

24. The method for game play of claim 1 wherein the various options are designated by letters on boxes.

25. The method for game play of claim 1 wherein the third option includes a positive option and a negative option.

26. The method for game play of claim 25 wherein the positive option is a monetary amount.

27. The method for game play of claim 26 wherein the positive option is a monetary multiplier.

28. The method for game play of claim 27 wherein the multiplier is a doubler.

29. The method for game play of claim 1 wherein the prize is money.

30. The method for game play of claim 1 wherein the prize is merchandise.

31. The method for game play of claim 1 wherein the prize is points.

32. The method for game play of claim 1 wherein the prize is further game play.

33. The method for game play of claim 32 wherein the further game play comprises a second game.

34. The method for game play of claim 33 wherein the monetary prize value of the first game is carried over to the subsequent game play.

35. The method for game play of claim 33 wherein the second game includes a plurality of levels.

36. The method for game play of claim 33 wherein the initial level in the second game equals the winning level from the first game.

37. The method for game play of claim 33 wherein the levels of the second game overlap with the levels of the first game.

38. The method for game play claim 37 wherein the over lap is a single monetary amount of overlap.

39. The method for game play of claim 1 wherein a vesting level is provided.

40. The method for game play of claim 39 wherein the vest level is increased through game play.

41. The method for game play of claim 1 further including designation one or more safe levels.

42. The method for game play of claim 1 further including designating one or more safe levels.

43. The method for game play of claim 42 wherein the designated reward is a monetary amount.

44. The method for game play of claim 1 wherein at least part of the game is broadcast.

45. The method for game play of claim 1 wherein at least part of the game is played on the internet.

46. The method for game play of claim 1 wherein the positive option corresponds to a monetary amount.

47. The method for game play claim 46 wherein the monetary amounts increase in arithmetic progression.

48. The method for game play claim 46 wherein the monetary amounts increase in multiplicative progression.

49. The method for game play of claim 48 wherein the multiplicative progression comprises a doubling of the monetary prize level by level.

50. The method for game play of claim 1 wherein a jackpot is awarded once the maximum game level is reached.

51. The method for game play of claim 1 wherein a proportionately large prize is awarded once the maximum game level is reached.

52. The method for game play of claim 1 wherein a guaranteed minimum prize is provided.

53. The method for game play if claim 1 wherein the prizing includes a guaranteed low end prize structure (GLEPS).

54. The method for game play of claim 1 wherein the various options are designated by numbers on boxes.

55. The method for game play of claim 1 wherein the various options are designated by numbers on boxes.

56. The method for game play of claim 1 wherein the third option includes the updating of a safe level for the player.

57. The method for game play of claim 1 wherein the third option includes an additional monetary amount.

* * * * *